United States Patent [19]

Wooden

[11] Patent Number: 4,655,194

[45] Date of Patent: Apr. 7, 1987

[54] SYSTEM FOR REMOVING FUMES

[75] Inventor: William G. Wooden, Louisville, Ky.

[73] Assignee: Heat Transfer Specialties, Inc., Louisville, Ky.

[21] Appl. No.: 852,134

[22] Filed: Apr. 15, 1986

[51] Int. Cl.[4] ..... F24C 15/20

[52] U.S. Cl. ..... 126/299 D; 55/DIG. 36; 55/415; 98/115.1

[58] Field of Search ..... 126/299 R, 299 D, 299 E, 126/300, 301; 55/DIG. 36, 415; 98/115.1, 36

[56] References Cited

U.S. PATENT DOCUMENTS

| | | | |
|---|---|---|---|
| 3,292,525 | 12/1966 | Jensen | 126/299 D |
| 3,411,428 | 11/1968 | Ahlrich | 126/299 D |
| 3,513,766 | 5/1970 | Ahlrich | 126/299 D |
| 3,664,255 | 5/1972 | Kuechler | 126/299 D |
| 3,690,245 | 9/1972 | Ferlise et al. | 98/115.1 |
| 3,766,906 | 10/1973 | Jenn | 126/299 R |
| 3,800,689 | 4/1974 | Brown | 126/299 D |
| 4,047,519 | 9/1977 | Nett | 126/299 D |
| 4,085,736 | 4/1978 | Kuechler | 126/299 D |
| 4,089,327 | 5/1978 | Welsh | 126/299 D |
| 4,166,448 | 9/1979 | Miller et al. | 126/299 D |
| 4,346,692 | 8/1982 | McCauley | 126/299 D |
| 4,493,312 | 1/1985 | Moon | 126/299 D |
| 4,586,486 | 5/1986 | Kaufman | 126/299 D |

*Primary Examiner*—James C. Yeung

*Attorney, Agent, or Firm*—William R. Price

[57] ABSTRACT

A system for removing fumes from the space above a cooking surface includes a hood, having front and side wall panels located above said cooking surface and covering the space above said cooking surface. The front wall panel is located forwardly of said cooking surface to form an entrainment chamber between said hood and said cooking surface. The entrainment chamber is in communication with air intake means and an exhaust means. The air intake means comprises an intake blower for introduction of air from the outside into a pressurized plenum located above said cooking surface. The pressurized plenum includes an air distribution baffle and an air velocity valve assembly, which opens into said entrainment chamber. The rear surface of said front panel supports an air foil, located below the air velocity valve assembly. The air foil extends across said hood, and projects at an acute angle toward the cooking surface. This directs the diffused air pattern from said air velocity valve assembly toward the fumes rising from said cooking surface, for mixture in the entrainment chamber. Exhaust means in operative relation with the entrainment chamber, removes the fumes and air mixture. The exhaust means includes an exhaust duct, an exhaust blower and a filter situated between said entrainment chamber and said exhaust means.

15 Claims, 9 Drawing Figures

SYSTEM FOR REMOVING FUMES

FIELD OF THE INVENTION

This invention relates to a system for removing grease and smoke and other fumes from the spaces above cooking surfaces, particularly in restaurants.

BACKGROUND OF THE INVENTION

Ventilation is employed to remove vapors arising from cooking oils and greases, which have been elevated above their vaporization temperature, as well as to remove odors associated with the preparation of food which may be considered objectionable in other parts of a building. Many known ventilating systems used in restaurants have been designed primarily as exhaust systems and depend upon the air within the building to move towards the ventilating systems and serve as a conducting vehicle to carry the fumes to be removed. Most of these exhaust systems employ some form of a canopy or hood, supported in a superior position relative to a cooking surface and provide a blower in communication with the hood to create a negative pressure, relative to the remainder of the building at an exhaust opening defined by the hood. These exhaust systems add an additional heat load to the air-conditioning or heating systems of such buildings. The additional heat load may represent as much as two-thirds of the total heat load of the building. Additionally, with such exhaust systems, which are employed to remove air laden with fumes and which contains an appreciable quantity of vaporized grease, there is a problem that the ambient air, which serves as the vehicle, is not at a sufficiently low temperature to effect condensation of the grease, prior to entry of the vaporized grease into a filter. Consequently, the vaporized grease escapes through the exhaust filter and subsequently condenses on the walls of the ducts in the exhaust system. This condensed grease constitutes a major fire hazard, particularly in restaurant buildings. Accordingly, many systems have adopted the use of a blower for both the exhaust and the inlet. However, due to the fact that air is then introduced from the outside, it is necessary to preheat the incoming air so as to prevent unduly lowering the temperature of the restaurant. This has been accomplished with some hood systems by the use of a perimeter supply plenum so that a laminar flow of air is introduced around the perimeter of the hood. This creates some discomfort for the cook standing directly below the flow of frigid air from the outside. Thus, in some cases, it has been found necessary to pretemper the cold air coming into the perimeter supply plenum defined by the hood.

DESCRIPTION OF THE PRIOR ART

References of which applicant is aware, relating to prior art hood systems, are as follows:

| U.S. PAT. NO. | INVENTOR | DATE |
|---|---|---|
| 3,292,525 | Jensen | 1966 |
| 3,411,428 | Ahlrich | 1968 |
| 3,513,766 | Ahlrich | 1970 |
| 3,625,135 | Carlson | 1971 |
| 3,664,255 | Kuechler | 1972 |
| 3,690,245 | Ferlise | 1972 |
| 3,766,906 | Jenn | 1973 |
| 3,800,689 | Brown | 1974 |
| 4,085,736 | Kuechler | 1978 |

-continued

| U.S. PAT. NO. | INVENTOR | DATE |
|---|---|---|
| 4,089,327 | Welsh | 1978 |
| 4,166,448 | Miller and Wooden | 1979 |

SUMMARY OF THE INVENTION

According to my invention, the perimeter supply plenum is eliminated. The present invention employs an intake blower and an exhaust blower. However, the intake blower blows air into a pressurized plenum, containing a distribution baffle and an air valve assembly. The distribution baffle consists of a plate extending across the plenum, which has been perforated with holes of a particular diameter. The air valve assembly is made up of adjustable air diffusion plates and diffusion assemblies comprising multilayer diffusion plates and secondary filters. The diffusion baffle is such to insure that the volume of inlet air is diffused and evenly spread across the pressurized plenum. This air forms an air pattern which corresponds generally to the planar surface of the cooking area. The cold inlet air therefore is directed from the pressurized plenum through the diffusion baffling and air valve assemblies onto an air foil angularly disposed toward the cooking surface and mixes with the hot fumes and volatilized greases rising from the cooking surface. This air mixture, then, is sufficiently cooled to insure the condensation and capture of the volatilized greases in the exhaust filter media and expulsion of the filtered gases through the exhaust chamber and the exhaust duct to the outer atmosphere.

DESCRIPTION OF THE PREFERRED EMBODIMENT

Figure 3:
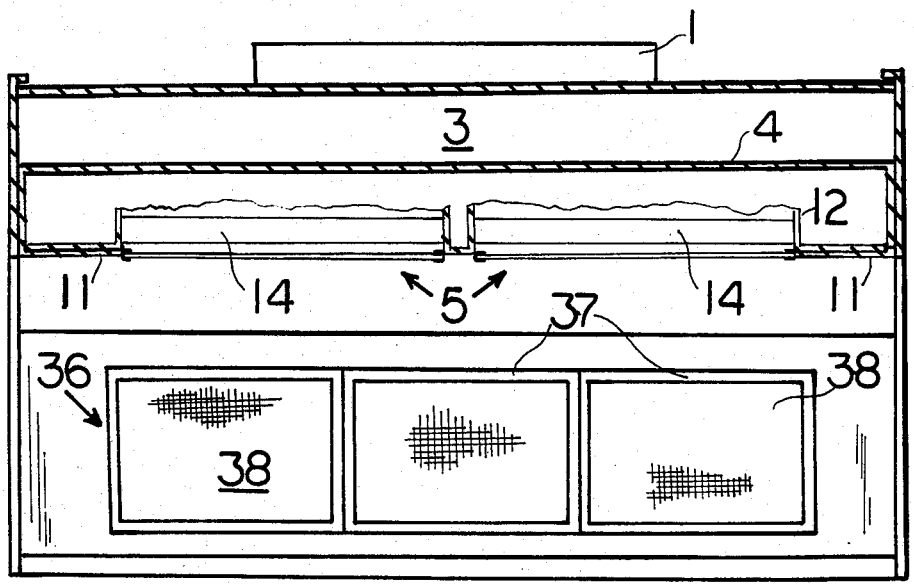
FIG. 3 is a sectional view, taken along lines 3—3 of FIG. 1, illustrating the pressurized plenum of the air intake system and the distribution baffling and air valve assemblies associated therewith in diffusing and delivering a diffused air pattern to the entrainment chamber of said hood.
Figure 4:
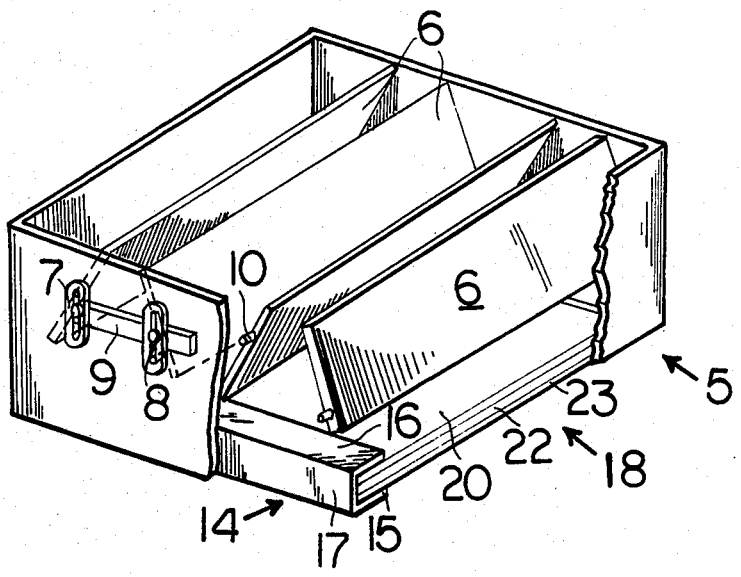
FIG. 4 is a fragmentary perspective view of the velocity valve assembly of the pressurized plenum illustrated in FIG. 3.
Figure 5:
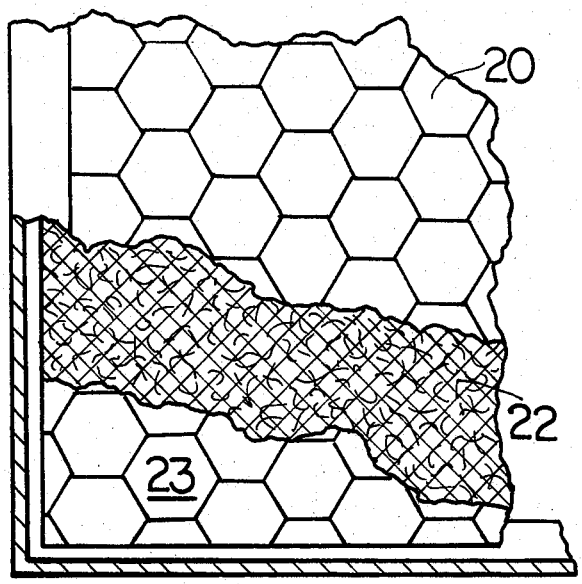
FIG. 5 is an enlarged view of the diffusion baffling and secondary filter with portions broken away to illustrate the construction of the frame and of the various layers.
Figure 6:
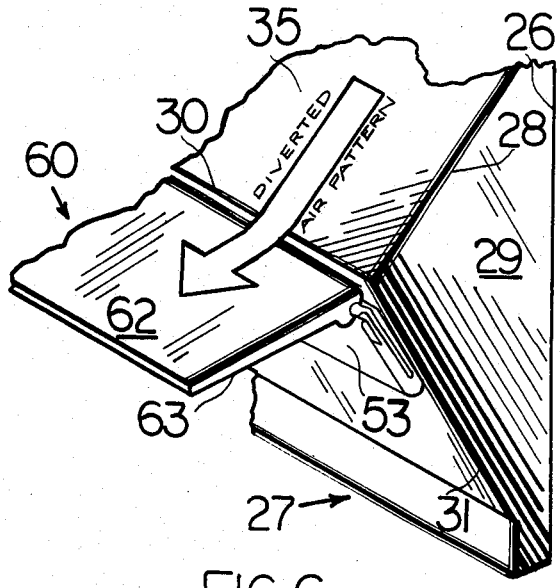
FIG. 6 is an enlarged, partially diagrammatic view of the stationary air foil of the front panel of said hood and of the adjustable air direction control vane, fitted in place in the vane retainer of said air foil.
Figure 7:
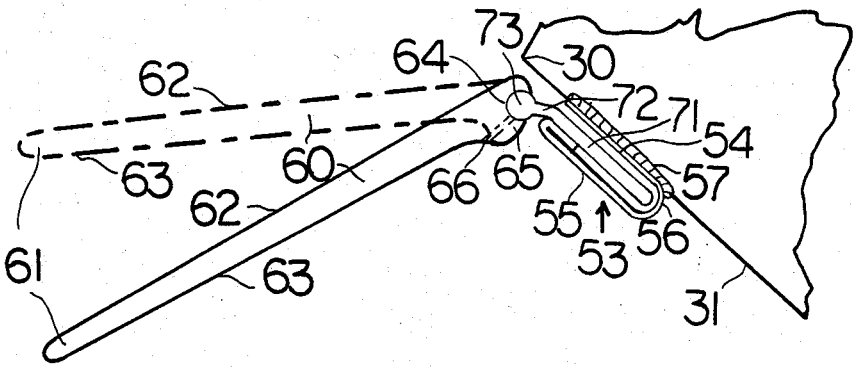
FIG. 7 is an enlarged and diagrammatic view of the stationary air foil and the adjustable air direction control vane.
Figure 8:
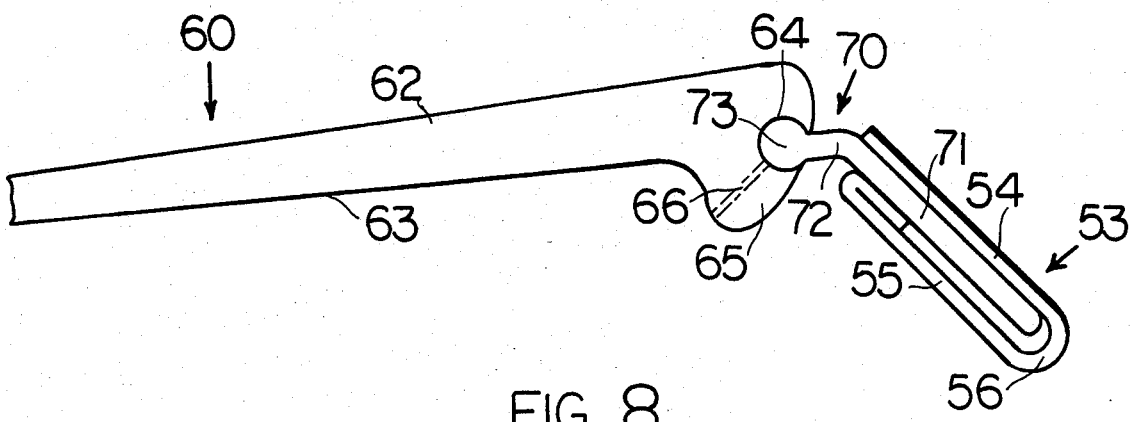
FIG. 8 is a view of the ball rod vane mounting pin and a portion of the adjustable air direction control vane, illustrating the ball and socket connection.
Figure 9:
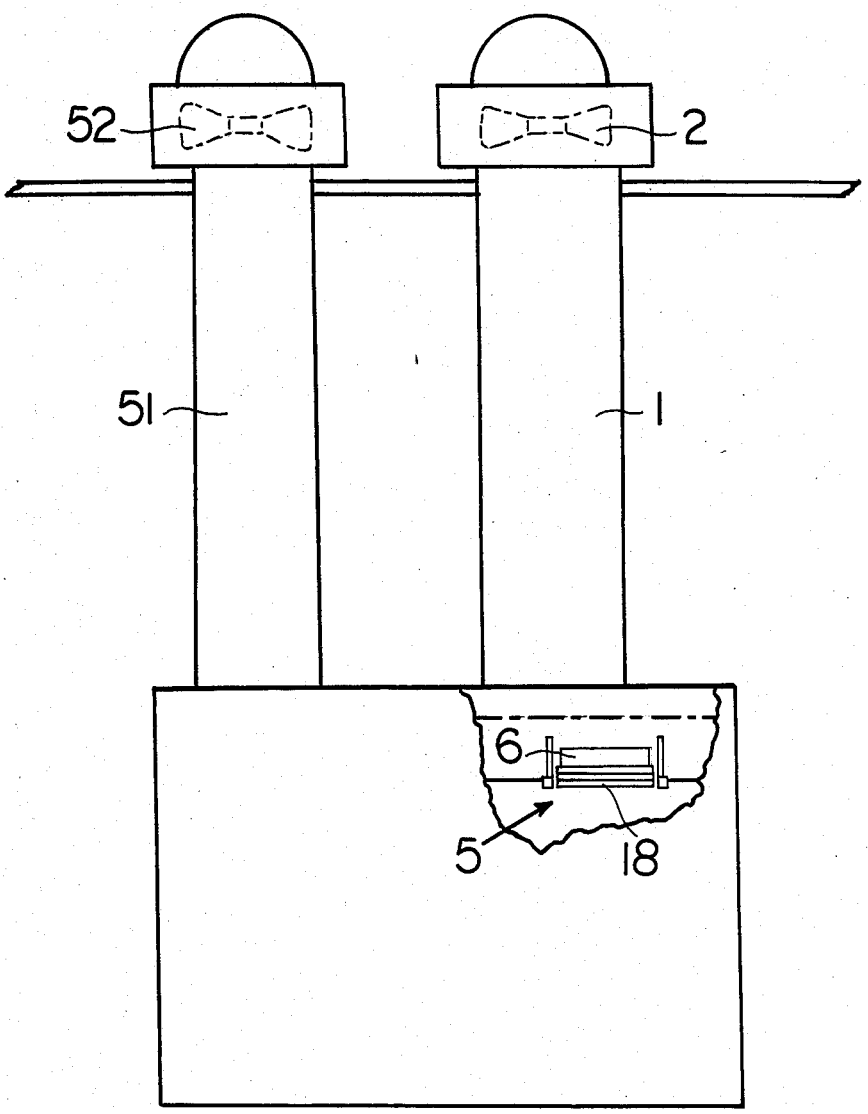
FIG. 9 is a view of the exhaust and intake air systems.

Referring now to the drawings, the supply air duct 1 contains a supply fan 2, which feeds into a pressurized plenum 3. The pressurized plenum 3 is best illustrated in FIGS. 3 and 4 and contains a distribution baffle 4, consisting of a galvanized steel plate containing uniformly spaced holes, preferably 3/16" in diameter, staggered on ¼" centers. In a preferred embodiment, the perforated holes are in excess of 18 per square inch and the galvanized steel sheet is 18 gauge.

Directly below the distribution baffle is a velocity air valve assembly 5, which comprise adjustable diffusion baffle plates 6. As can best be seen in FIG. 4, the diffusion plate 6 is arranged through the co-action of a pin 10, fitted in the slot 8 of slotted member 7. The pin fits onto a horizontal adjustment arm 9, and thereby connects with adjustable diffusion baffles 6. Therefore, by lowering the horizontal adjustment arm 9, the baffles 6 come closer together, while, by raising the adjustment arm to the top, the adjustment baffles take on almost a vertical disposition. The floor 11 of the plenum 3 contains a wall 12 which surrounds the air valve assemblies 5. Contained inside the opening defined by wall 12 is a frame 14, having a lower leg 15 and upper leg 16 and a square bight portion 17. The diffusion baffle 18 and secondary filter, made up of three or more layers, is slidably positioned into the frame 14. The upper layer 20, as is illustrated, contains an upper honeycomb layer of aluminum, while the intermediate layer 22 is a twisted mesh layer of aluminum and the lower layer 23 contains a lower honeycomb layer. Air passing through the air valve velocity diffusion plate leaves the edge of the diffusion plate 6 at 506 FPM-560 FPM, and is completely diffused in going through the diffusion baffle and secondary filter into the entrainment chamber C, formed by the hood 25. The hood consists of a front panel 26, rear wall 27 and an angularly disposed rear portion 28 of the front panel 26, forming a fixed air foil 29. The angularly disposed wall 28, which is angled at 30, depends backwardly into a depending wall 31 and terminates at 32. The hood also contains side panels 33, a back panel 34 and a depending, diagonally-disposed top panel 35, joining with the floor of the plenum 3.

The diagonally disposed top panel has a filter opening 36, containing filter frame 37 in which a filter 38 is fitted. The grill or stove is shown as 41, containing the cooking surfaces 42. From the hot cooking surface, fumes and volatilized cooking components 43, such as volatilized grease and steam, flow upwardly and are mixed with the cold air supply pattern 46 in a diffused air pattern, to form a diffused mixture of warm air 48 sufficiently cooled so as to condense any volatilized grease so as to be caught in the exit filter 38. The hot fumes 43 and fresh inlet air 46 are thus exited as a diffused mixture 48 through the filter media 38 into the exhaust plenum 50, which fits onto the exhaust stack 51, containing an exhaust fan 52.

Figure 1:
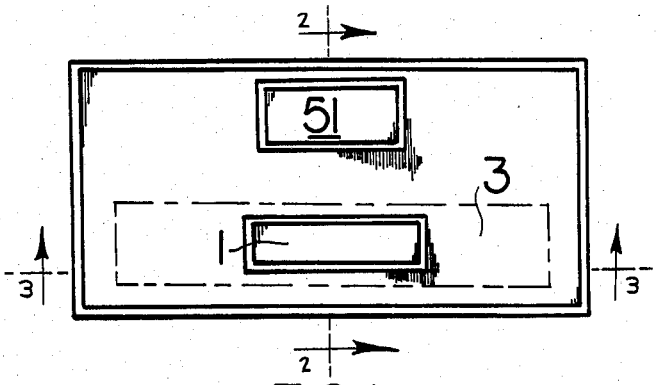
FIG. 1 is a plan view of the hood of this invention and the plenum connections.
Figure 2:
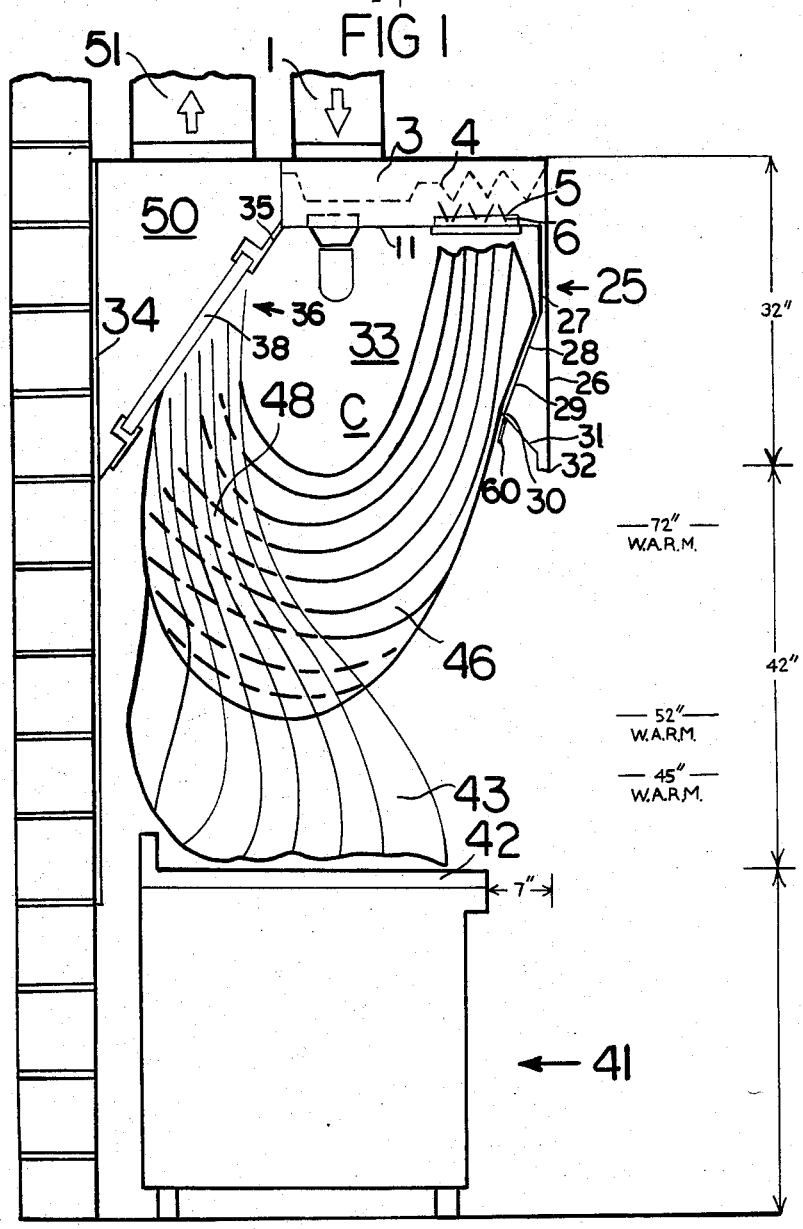
FIG. 2 is a sectional view, taken along lines 2—2 of FIG. 1, illustrating the arrangement of the hood system over the cooking surface and the arrangement of the air intake system and the exhaust air exit system relative to the gas and entrainment chamber of the hood.

As can be seen in FIG. 2, the hood 25 is designed to provide head room of about 6½ feet for the cook. The Work Area Reference Area (WARM) drawn to a scale of ¼"=1'0" allows a space from the front of the grill to the reference line of 1.5'.

Now, in some instances, it is necessary to direct the air pattern 46 from the inlet to a higher point than is shown in the drawings. This is accomplished through the use of an adjustable air direction control vane, somewhat similar to a aileron of an airplane. The adjustable air direction control vane 60 contains a thin distal edge 61 and upper surface 62 and a lower surface 63, which tapers forming a thicker dimension proximally, terminating in a lower surface protuberance 65, containing a socket 64 and an opening for a set screw 66. A ball rod vane pin 70, having a shank 71, an angled portion 72 and a ball at its distal end 73, can be fitted into the socket 64 to allow for various directions of flow of the air from the fixed air foil 29 onto the adjustable air direction control vane 60. The ball rod vane pin fits into a vane retaining clip 53, having a rear wall 54, a front wall 55, a curved bight portion 56, and is welded at 57 to the depending wall 31 of the rear portion of the front panel 26. Several of these clips can be welded to the depending wall, near the angle 30 to support and adjust the adjustable air direction control vane 60, which is then set into position by set screw 66. In this manner, taller cooking utensils, such as Dutch ovens and the like, can be utilized, in which the fumes generated therefrom are mixed at a higher level than that shown in the attached drawing.

It has been found that it is not necessary to utilize a series of monitors to measure the static pressure of inlet and exit systems and the air flow between the inlet fan 2 and the exit fan 52, is adjusted in the field, so that the flow of air into the system equals the flow of air and fumes out of the system, without a loss of tempered air from the restaurant portion per se.

Many modifications will occur to those skilled in the art from the detailed description which has been given hereinabove, which is meant to be exemplary in nature and nonlimiting, except so as to be commensurate in scope with the appended claims.

I claim:

1. A system for removing fumes, including the products of combustion and volatilization incident to cooking, from the space above a cooking surface, with a minimum of disturbance or displacement of ambient air, which comprises:

A. a hood having front and side wall panels located above said cooking surface and covering the space above said cooking surface and extending forwardly of said cooking surface to form an entrainment chamber between said hood and said cooking surface, which is generally co-extensive with the width of said cooking surface and which extends forwardly of said cooking surface;

B. air intake means having:

1. an intake blower for introduction of air from the outside into the entrainment chamber,
2. a pressurized plenum, located above said cooking surface for receipt of air from said air intake means, which includes:
   a. air distribution baffle;
   b. an air velocity valve assembly comprising:
      1. adjustable air diffusion plates arranged transversely across said plenum, and
      2. a diffusion baffle and secondary filter at the bottom of said pressurized plenum, which opens into said entrainment chamber:

C. an air foil located below the diffusion grill and extending across the front panel of said hood and projecting at an acute angle toward the cooking surface for directing the diffused air pattern toward the fumes rising from said cooking surface for mixture within the entrainment chamber;

D. exhaust means in operative relation with the entrainment chamber of said hood, which includes:

1. an exhaust stack, and 2. an exhaust blower:

E. filter means situated between said entrainment chamber of said hood and said exhaust means.

2. A system, as defined in claim 1, in which said distribution baffle comprises a sheet of perforated metal having uniformly-spaced holes which provide more than 50% of open area.

3. A system, as defined in claim 2, in which the uniformly-spaced holes of said distribution baffling are 3/16" in diameter, staggered on ¼" centers.

4. A system, as defined in claim 2, in which the distribution baffling is fabricated of a sheet of galvanized steel.

5. A system, as defined in claim 4, in which said galvanized steel is 18 gauge.

6. A system, as defined in claim 2, in which the perforated holes are in excess of 18 per square inch.

7. A system, as defined in claim 1, in which said diffusion baffle and secondary filter comprises multiple layers of metal mesh materials.

8. A system, as defined in claim 7, in which said multiple layers of metal include a top and bottom layer of metal honeycomb and an intermediate layer of twisted metal mesh.

9. A system, as defined in claim 1, in which said adjustable air diffusion plates comprise pairs of plates, each plate extending downwardly in a diverging and spreading pattern.

10. A system, as defined in claim 1, in which said air foil has an adjustable air direction control vane, pivotably mounted near its terminal end for adjusting the direction of the intake air pattern.

11. A system, as defined in claim 1, in which said air foil is disposed at a first angle, having an upper leg which projects forwardly from the rear of the front wall panel of said hood and which has a lower leg which projects from the apex of said angle toward the rear portion of the front wall panel.

12. A system, as defined in claim 11, in combination with a U-shaped vane retaining clip, welded along the lower leg of said air foil, near the apex of said angle.

13. A system, as defined in claim 12, in combination with an air direction control vane, having:

A. a longitudinal body portion which is thinner at its distal edge than at its proximal edge and which contains a socket on the lower portion of its proximal edge, B. a mounting support pin, having a ball at its distal edge for pivotably mounting in the socket of said air direction control vane, C. an elongated leg for mounting in said U-shaped vane retaining clip of said air foil.

14. A system, as defined in claim 13, the combination with an air direction vane of a set screw for engagement with the ball of said mounting pin.

15. A system, as defined in claim 13, in which the elongated leg is bent at an angle near its distal end.

* * * * *